US007247107B1

(12) United States Patent
Bedwell

(10) Patent No.: US 7,247,107 B1
(45) Date of Patent: Jul. 24, 2007

(54) IMPACT-ABSORBING LACROSSE BALL

(75) Inventor: Katelyn Marie Bedwell, Baltimore, MD (US)

(73) Assignee: STX, LLC, Baltimore, MD (US)

( * ) Notice: Subject to any disclaimer, the term of this patent is extended or adjusted under 35 U.S.C. 154(b) by 0 days.

(21) Appl. No.: 11/199,393

(22) Filed: Aug. 9, 2005

Related U.S. Application Data

(60) Provisional application No. 60/600,793, filed on Aug. 12, 2004.

(51) Int. Cl.
*A63B 37/12* (2006.01)

(52) U.S. Cl. ..... 473/595; 473/609

(58) Field of Classification Search ..... 473/600–605, 473/595, 614, 609
See application file for complete search history.

(56) References Cited

U.S. PATENT DOCUMENTS

| | | | | |
|---|---|---|---|---|
| 2,006,230 | A * | 6/1935 | Dobbins | 473/595 |
| 4,454,253 | A | 6/1984 | Murphy et al. | |
| 5,048,829 | A * | 9/1991 | Prokupek | 473/595 |
| 5,131,665 | A * | 7/1992 | Myers | 473/600 |
| 5,433,438 | A | 7/1995 | Gilman | |
| 5,704,858 | A * | 1/1998 | Yang | 473/602 |
| 6,369,125 | B1 * | 4/2002 | Nesbitt | 522/142 |
| 7,048,656 | B2 * | 5/2006 | Litchfield | 473/598 |
| 2004/0018901 | A1 | 1/2004 | Morrow et al. | |

FOREIGN PATENT DOCUMENTS

DE 23 59 704 6/1975

OTHER PUBLICATIONS

Brine Lacrosse Balls (Orange, Soft Training); (website); Jun. 23, 2004; URL <http://www.amazon.com/exec/obidos/tg/-/B0000BYMI/104-5656478-3331900?v=glance&n=341... >; United States.

Champion Sports NFHS Approved Practice Lacrosse Balls—12 Pack (White); (website); Jun. 23, 2004; URL <http://www.amazon.com/exec/obidos/tg/-/B0001N9VN8/104-5656478-3331900?v=glance&n=341...>; United States.

Champion Sports NFHS Approved Practtice Lacrosse Balls—12 Pack; (website); Jun. 23, 2004: URL <http://www.gartsports.com/product/index.jsp?productID=1756735&cp=711658.694183&parentPage=family>; United States.

* cited by examiner

*Primary Examiner*—Steven Wong
(74) *Attorney, Agent, or Firm*—Paul, Hastings, Janofsky & Walker LLP

(57) ABSTRACT

A lacrosse ball that meets generally accepted rules on the construction of lacrosse balls (e.g., size, weight, and bounce height), but provides a more impact-absorbing surface than conventional lacrosse balls. One embodiment provides a lacrosse ball including a shell made of a first material and a layer of second material disposed on the shell, wherein the second material has a specific gravity lower than that of the first material. Another embodiment provides a lacrosse ball including a core made of a first material and a layer of second material disposed on the core, wherein the second material has a specific gravity lower than that of the first material. Another embodiment provides a lacrosse ball including a core made of a first material and a layer of second material disposed on the core, wherein the second material has a specific gravity higher than that of the first material.

8 Claims, 2 Drawing Sheets

IMPACT-ABSORBING LACROSSE BALL

This application claims the benefit of U.S. Provisional Application No. 60/600,793 filed Aug. 12, 2004, which is herein incorporated by reference in its entirety.

BACKGROUND

1. Field of the Invention

The present invention relates generally to lacrosse balls, and more particularly, to a lacrosse ball that meets generally accepted rules on the construction of lacrosse balls (e.g., size, weight, and bounce height), but provides a more impact-absorbing surface than conventional lacrosse balls.

2. Background of the Invention

Injuries are detrimental to the popularity of the sport of lacrosse. Injuries can cause existing players to abandon the game and can discourage potential players from ever trying the game. One source of injury in lacrosse is due to the hard, heavy rubber lacrosse ball. Despite the use of personal protective gear, the lacrosse ball frequently contacts a player's body, often at high speeds and with great force. The impact of the ball can cause bruises and broken bones.

The generally accepted rules for competitive lacrosse define the construction requirements of a lacrosse ball. The specific requirements vary somewhat between the different competitive leagues (e.g., high school, NCAA, and professional), but generally fall within a range of sizes, weights, and bounce heights. One example of a rule on lacrosse ball construction is the 2004 NCAA Men's Lacrosse Rule 1–17, which states the following:

> The ball shall be of white, yellow, orange or lime green solid rubber—between 7¾ and 8 inches in circumference, between 5 and 5¼ ounces in weight and, when dropped from a height of 72 inches upon a concrete floor, shall bounce 43 to 51 inches at a temperature of 65° to 70° Fahrenheit.

Another exemplary rule is the 2001 US Lacrosse Women's Rule 2, which states the following:

> The ball is rubber of solid yellow color, not less than 20 cm (7¾") nor more than 20.3 cm (8") in circumference. It must weigh not less than 142 gm (5 oz.) nor more than 149 gm (5¼ oz.). It must have a bounce of not less than 1.1 m (43") nor more than 1.3 m (51") when dropped from 1.8 m (72") onto concrete at a temperature of approximately 18° C. (65° F.) –23° C. (75° F.).

Another exemplary rule is the 2001 International Women's Lacrosse Rule 4, which states the following:

> A. The ball shall be rubber, of any solid colour, with a circumference of 20 cm (minimum) to 20.3 cm (maximum).
>
> B. The ball shall weigh not less than 142 g or more than 149 g. It must bounce between 1.1 m and 1.3 m when dropped from 1.8 m onto concrete at a temperature between 18° C. and 23° C.

BRIEF SUMMARY OF THE INVENTION

The present invention provides a lacrosse ball that distributes its impact over a larger surface area by deforming to a much larger degree than conventional solid rubber lacrosse balls.

In analyzing impact, impulse force (force multiplied by time) is equal to momentum change (mass times change in velocity). A ball with $\chi$ momentum must experience $\chi$ units of impulse to be brought to a stop. The greater the time the ball is in contact with a player's body, the smaller the force acting on the body. Thus, by increasing the impact time, the lacrosse ball of the present invention minimizes the force on the body involved in the collision, and thereby reduces the chance of injury.

To achieve the desired deformation, one embodiment of the present invention provides a lacrosse ball having a hollow interior. Another embodiment provides a lacrosse ball having a soft core with an exterior cover that is harder than the core. Another embodiment provides a lacrosse ball having a dense solid core and a softer outer layer overmolded onto the dense core.

While providing the desired deformation, these embodiments of the present invention also comply with generally accepted rules on the construction of a lacrosse ball, which concern, for example, the circumference, weight, and bounce height of the lacrosse ball.

DETAILED DESCRIPTION OF THE INVENTION

The present invention provides a lacrosse ball that meets generally accepted rules on the size, weight, and bounce height of lacrosse balls, but provides more impact-absorption than conventional lacrosse balls. In each embodiment of the present invention, the lacrosse ball, upon impact, deforms more dramatically than a conventional lacrosse ball and thereby absorbs more impact energy and reduces the chance of injury.

A first embodiment of the present invention provides a lacrosse ball having a hollow interior.

A second embodiment of the present invention provides a lacrosse ball having a soft core with an exterior cover that is harder than the core.

A third embodiment of the present invention provides a lacrosse ball having a dense core and a less dense outer layer over (e.g., overmolded over) the dense core. The outer layer could be, for example, a compressible foam or an elastomer. In one aspect of this embodiment, the outer layer covers portions of the dense core, leaving other portions of the dense core exposed at the outer surface of the ball. In another aspect of this embodiment, the outer layer fully encases the dense core.

As used herein, the terms softer or harder refer to the relative hardness of the different materials of a lacrosse ball. The hardness of materials (e.g., plastics) is most commonly measured by the Rockwell hardness test or Shore (Durometer) hardness test. Both methods measure the resistance of the material toward indentation and provide an empirical hardness value. In addition, as used herein, density refers to the mass of a material divided by its volume. Specific gravity (which is expressed without units) refers to the heaviness or density of a material compared to water.

Figure 1A:
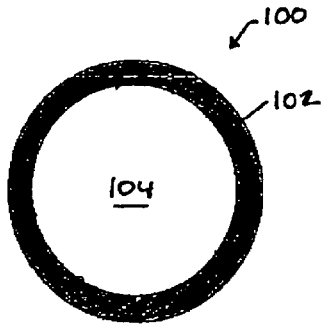
FIGS. 1A–1E are schematic diagrams of cross-sectional views of exemplary lacrosse balls having a hollow interior, according to the first embodiment of the present invention.

FIGS. 1A–1E are schematic diagrams of cross-sectional views of exemplary lacrosse balls having a hollow interior, according to the first embodiment of the present invention. As shown in FIG. 1A, an exemplary lacrosse ball 100 includes a shell 102 with a hollow interior 104. The shell 102 is made of material that is denser (i.e., has a higher specific gravity) than the typical material of a conventional lacrosse ball, in order to compensate for the hollow interior 104 and provide a ball having a weight similar to a conventional ball and within the range of generally accepted weights for lacrosse balls (e.g., as defined by generally accepted game rules).

In one example, shell 102 is made of a thermoplastic, has an outer circumference of between about 7¾ inches to about 8 inches, has a wall thickness of about a ½-inch, weighs between about 5 and 5¼ ounces, and bounces between about 43 inches and about 51 inches when dropped from a height of about 72 inches upon a concrete floor at a temperature of about 65° to 75° Fahrenheit.

Shell 102 is made of material that deforms when ball 100 impacts a surface, effectively creating a flat side of ball 100 that contacts the surface. In this manner, ball 100 disperses the impact over a larger surface area, increases the time that ball 100 contacts the surface, and decreases the force on the surface.

Figure 1B:
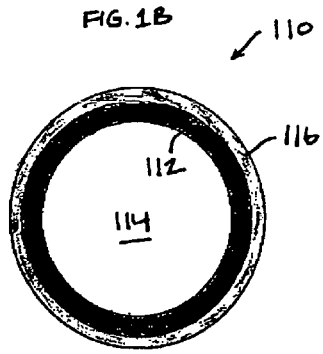

FIG. 1B illustrates another exemplary lacrosse ball 110, according to another aspect of this embodiment of the present invention. As shown, ball 110 includes an inner shell 112 having a hollow interior 114, and an outer layer 116 encasing the shell 112. The outer layer 116 is made of a material that is more compressible and has a lower specific gravity than the inner shell 1112. The material of the outer layer 116 is, for example, a compressible foam or elastomer, and is preferably overmolded onto inner shell 112.

Outer layer 116 and inner shell 112, together, have a weight similar to that of a conventional ball and within the range of generally accepted weights for lacrosse balls (e.g., as defined by generally accepted game rules). In one example, the outer layer 116 is made of silicone and the inner shell 112 is made of a thermoplastic, the outer layer 116 has an outer circumference of between about 7¾ inches to about 8 inches and has a wall thickness of about ¼-inch, the inner shell 112 has a wall thickness of about a ½-inch, and the entire ball 110 weighs between about 5 and 5¼ ounces and bounces between about 43 inches and about 51 inches when dropped from a height of about 72 inches upon a concrete floor at a temperature of about 65° to 75° Fahrenheit.

Both outer layer 116 and inner shell 112 are made of materials that deform when ball 110 impacts a surface, effectively creating a flat side of ball 110 that contacts the surface. In this manner, ball 110 disperses the impact over a larger surface area, increases the time that ball 110 contacts the surface, and decreases the force on the surface.

Figure 1C:
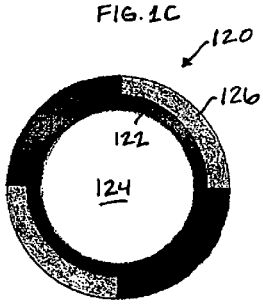

FIG. 1C illustrates another exemplary lacrosse ball 120, according to another aspect of this embodiment of the present invention. As shown, ball 120 includes a shell 122 having a hollow interior 124, and pads 126 disposed in isolated, discrete locations on the outer surface of shell 122. Pads 126 are preferably evenly spaced around the outer surface of shell 122. Pads 126 are made of a material that is more compressible and has a lower specific gravity than the material of the shell 122. The material of pads 126 is, for example, a compressible foam or elastomer, and is preferably overmolded onto shell 122. As shown in FIG. 1C, in this embodiment, pads 126 are disposed in recesses of shell 122 and are flush with the outer surface of shell 122.

Shell 122 and pads 126, together, have a weight within the range of generally accepted weights for lacrosse balls. In one example, there are eight evenly spaced pads 126 on ball 120, the shell 122 is made of a thermoplastic and the pads 126 are made of EVA (Ethylene Vinyl Acetate) foam, the ball 120 has a circumference of between about 7¼ inches to about 8 inches, the shell 122 has a wall thickness of about ¾-inch (at its fullest thickness), the pads 126 have a thickness of about ½-inch and take up about 4 square inches of the surface area of the ball 120, and the entire ball 120 weighs between about 5 and 5¼ ounces and bounces between about 43 inches and about 51 inches when dropped from a height of about 72 inches upon a concrete floor at a temperature of about 65° to 75° Fahrenheit.

Both shell 122 and pads 126 are made of materials that deform when ball 120 impacts a surface, effectively creating a flat side of ball 120 that contacts the surface. In this manner, ball 120 disperses the impact over a larger surface area, increases the time that ball 120 contacts the surface, and decreases the force on the surface.

Figure 1D:
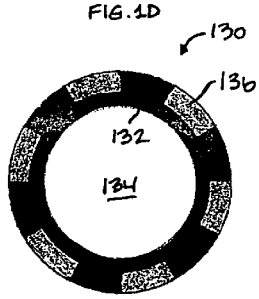

FIG. 1D illustrates another exemplary lacrosse ball 130, according to another aspect of this embodiment of the present invention. As shown, ball 130 includes a shell 132 having a hollow interior 134, and pads 136 disposed in isolated, discrete locations on the outer surface of shell 132. The embodiment of FIG. 1D is similar in most respects to the embodiment of FIG. 1C, except that ball 130 includes more pads 136, with each pad 136 taking up a smaller surface area of the shell 132. Pads 136 are preferably evenly spaced around the outer surface of shell 132. Pads 136 are made of a material that is more compressible and has a lower specific gravity than the material of shell 132. The material of pads 136 is, for example, a compressible foam or elastomer, and is preferably overmolded onto shell 132. Pads 136 are disposed in recesses of shell 132 and are flush with the outer surface of shell 132.

Shell 132 and pads 136, together, have a weight within the range of generally accepted weights for lacrosse balls. In one example, there are sixty pads 136 on ball 130, the shell 132 is made of a thermoplastic and the pads 136 are made of EVA foam, the ball 130 has a circumference of between about 7¾ inches to about 8 inches, the shell 132 has a wall thickness of about ¾-inch (at its fullest thickness), the pads 136 have a thickness of about ½-inch and take up about 5 square inches of the surface area of the ball 130, and the entire ball 130 weighs between about 5 and 5¼ ounces and bounces between about 43 inches and about 51 inches when dropped from a height of about 72 inches upon a concrete floor at a temperature of about 65° to 75° Fahrenheit.

Both shell 132 and pads 136 are made of materials that deform when ball 130 impacts a surface, effectively creating a flat side of ball 130 that contacts the surface. In this manner, ball 130 disperses the impact over a larger surface area, increases the time that ball 130 contacts the surface, and decreases the force on the surface.

Figure 1E:
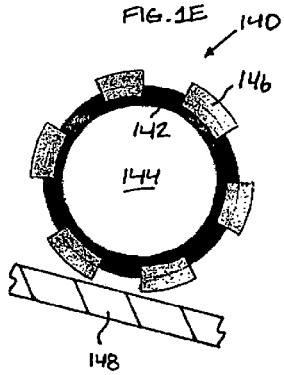

FIG. 1E illustrates another exemplary lacrosse ball 140, according to another aspect of this embodiment of the present invention. As shown, ball 140 includes a shell 142 having a hollow interior 144, and pads 146 disposed in isolated, discrete locations on the outer surface of shell 142. The embodiment of FIG. 1E is similar in most respects to the embodiment of FIG. 1D, except that pads 146 protrude above (i.e., are not flush with) the outer surface of shell 142. In this manner, pads 146 provide a greater degree of cushioning, and reduce the likelihood of the harder shell 142's contacting a player's body. Pads 146 are made of a material that is more compressible and has a lower specific gravity than the material of shell 142. The material of pads 146 is, for example, a compressible foam or elastomer, and is preferably overmolded onto shell 142. Although FIG. 1E shows pads 146 disposed in recesses of shell 142, as an alternative, shell 142 could have no recesses and pads 146 could be applied to the flat exterior surface of shell 142.

Shell 142 and pads 146, together, have a weight within the range of generally accepted weights for lacrosse balls. In one example, there are one hundred pads 146 on ball 140, the shell 142 is made of a thermoplastic and the pads 146 are made of silicone, the ball 140 has a circumference of between about 7¾ inches to about 8 inches, the shell 142 has a wall thickness of about ½-inch (at its fullest thickness), the pads 146 have a thickness of about ½-inch and take up about 6 square inches of the surface area of the ball 140, and the entire ball 140 weighs between about 5 and 5¼ ounces and bounces between about 43 inches and about 51 inches when dropped from a height of about 72 inches upon a concrete floor at a temperature of about 65° to 75° Fahrenheit.

Both shell 142 and pads 146 are made of materials that deform when ball 140 impacts a surface, effectively creating a flat side of ball 140 that contacts the surface. In this manner, ball 140 disperses the impact over a larger surface area, increases the time that ball 140 contacts the surface, and decreases the force on the surface. The raised pads 146 also reduce the probability of the harder shell 142's contacting the surface.

In a further aspect of ball 140 of FIG. 1E, pads 146 are sized and configured on ball 140 such that pads 146 must contact a planar surface first before the exterior of shell 142 can contact the planar surface. For example, upon contact with a planar surface, at least two pads contact the planar surface, deform as a result of the impact, and, because of the deformation, allow the exterior of shell 142 to then contact the planar surface. FIG. 1E illustrates this aspect of the invention, illustrating pads 146 in relation to a planar surface 148.

Alternatively, instead of deforming to an extent that allows the exterior of shell 142 to contact the planar surface, pads 146 can deform to a lesser extent and cause the entire shell 142 to deform (e.g., flatten out) without allowing the exterior of shell 142 to contact the planar surface. In this manner, the plurality of pads prevents the exterior of the shell from contacting the planar surface.

Figure 2:
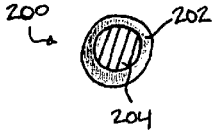
FIG. 2 is a schematic diagram of a cross-sectional view of an exemplary lacrosse ball having a soft core with an exterior cover that is harder than the core, according to an embodiment of the present invention.

FIG. 2 is a schematic diagram of a cross-sectional view of an exemplary lacrosse ball 200 having a soft core with an exterior cover that is harder than the core, according to the second embodiment of the present invention. As shown, ball 200 includes a core 204 and a shell 202 surrounding core 204. Core 204 is made of material that has a lower specific gravity than the material of shell 202. For example, shell 202 could be made of a thermoplastic, while core 204 could be made of a compressible foam. Ball 200 of FIG. 2 is similar in some respects to ball 100 of FIG. 1A, except that, instead of being hollow, shell 202 is filled with a core 204 that is less dense than the shell 202.

Shell 202 and core 204, together, have a weight within the range of generally accepted weights for lacrosse balls. In one example, the core 204 is made of EVA foam and the shell 202 is made of a thermoplastic, the shell 202 has a circumference of between about 7¼ inches to about 8 inches and a wall thickness of about ¼-inch, the core 204 has a circumference of about 6 inches, and the entire ball 200 weighs between about 5 and 5¼ ounces and bounces between about 43 inches and about 51 inches when dropped from a height of about 72 inches upon a concrete floor at a temperature of about 65° to 75° Fahrenheit.

Shell 202 is made of a material that deforms when ball 200 impacts a surface, effectively creating a flat side of ball 200 that contacts the surface. Core 204 may also deform, depending on the thickness of shell 202 and the force at which ball 200 strikes the surface. In this manner, ball 200 disperses the impact over a larger surface area, increases the time that ball 200 contacts the surface, and decreases the force on the surface.

Figure 3B:
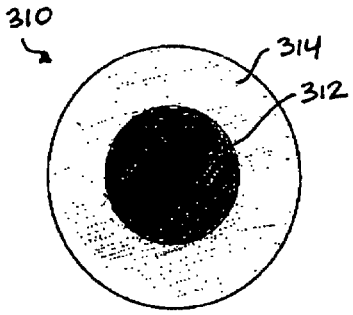
FIGS. 3A and 3B are schematic diagrams of cross-sectional views of exemplary lacrosse balls having a dense core and an outer layer overmolded onto the dense core, according to an embodiment of the present invention.
Figure 3A:
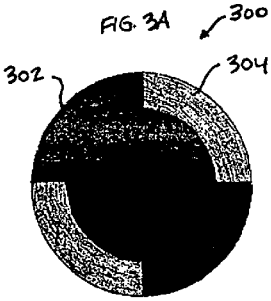

FIGS. 3A and 3B are schematic diagrams of cross-sectional view of exemplary lacrosse balls having a dense core and an outer layer overmolded onto the dense core, according to the third embodiment of the present invention. As shown in FIG. 3A, one aspect of this embodiment provides a ball 300 that includes a solid core 302 and pads 304 disposed in isolated, discrete locations on the outer surface of core 302. Ball 300 of FIG. 3A is similar in some respects to ball 120 of FIG. 1C, except that core 302 is not hollow. As shown in FIG. 3A, in this embodiment, pads 304 are disposed in recesses of core 302 and are flush with the outer surface of core 302.

As an alternative, pads 304 could also be raised as shown in FIG. 1E, and either disposed in recesses of core 302 or applied to the flat exterior surface of core 302 (in which case, core 302 would not have recesses). As described above in reference to FIG. 1E, if pads 304 are raised, pads 304 can also be sized and configured on ball 300 such that pads 304 must contact a planar surface first before the exterior of shell 142 can contact the planar surface. In addition, pads 304 can also be configured to prevent the exterior of the shell from contacting the planar surface.

Pads 304 are made of a material that is more compressible and has a lower specific gravity than the material of core 302. For example, core 302 could be made of a thermoplastic, while the material of pads 304 could be, for example, a compressible foam or elastomer, which is preferably overmolded onto core 302.

Core 302 and pads 304, together, have a weight within the range of generally accepted weights for lacrosse balls. In one example, there are eight pads 304 on ball 300, the core 302 is made of a thermoplastic and the pads 304 are made of silicone, the ball 300 has a circumference of between about 7¾ inches to about 8 inches, the pads 304 have a thickness of about ½-inch and take up about 4 square inches of the surface area of the ball 300, and the entire ball 300 weighs between about 5 and 5¼ ounces and bounces between about 43 inches and about 51 inches when dropped from a height of about 72 inches upon a concrete floor at a temperature of about 65° to 75° Fahrenheit.

Core 302 and pads 304 are made of materials that deform when ball 300 impacts a surface, effectively creating a flat side of ball 300 that contacts the surface. In this manner, ball 300 disperses the impact over a larger surface area, increases the time that ball 300 contacts the surface, and decreases the force on the surface.

FIG. 3B illustrates another exemplary lacrosse ball 310, according to another aspect of this embodiment of the present invention. As shown, ball 310 includes an inner core 312 and an outer layer 314 encasing the inner core 312. The outer layer 314 is made of a material that is more compressible and has a lower specific gravity than the inner core 312. The material of the outer layer 314 is, for example, a compressible foam or elastomer.

Outer layer 314 and inner core 312, together, have a weight within the range of generally accepted weights for lacrosse balls. In one example, the outer layer 314 is made of silicone and the inner core 312 is made of a thermoplastic, the outer layer 314 has an outer circumference of between about 7¾ inches to about 8 inches, the inner core has a circumference of about 4 inches, and the entire ball 310 weighs between about 5 and 5¼ ounces and bounces between about 43 inches and about 51 inches when dropped from a height of about 72 inches upon a concrete floor at a temperature of about 65° to 75° Fahrenheit.

Outer layer 314 is made of a material that deforms when ball 310 impacts a surface, effectively creating a flat side of ball 310 that contacts the surface. Core 312 may also deform, depending on the thickness of outer layer 314 and the force at which ball 310 strikes the surface. In this manner, ball 310 disperses the impact over a larger surface area, increases the time that ball 310 contacts the surface, and decreases the force on the surface.

In preferred embodiments of the present invention, each of the embodiments of FIGS. 1A–3B provides a lacrosse ball that generally conforms to widely accepted rules on the construction of a lacrosse ball. In accordance with these rules, embodiments of the present invention provide a lacrosse ball having a circumference, weight, and bounce height within a range that encompasses the rules set forth above. For example, an embodiment of the present invention provides a lacrosse ball having a circumference within a range of about 7½ to 8½ inches, a weight within a range of about 4¾ to 5½ ounces, and a bounce height within a range of about 40 to 55 inches, when dropped from a distance of approximately 65 to 75 inches onto concrete at a temperature between approximately 60° F. and 80° F.

In a preferred form of the present invention, a dense shell (e.g., shell 112 of FIG. 1B) or a dense core (e.g., core 302 of FIG. 3A) is constructed of a material that provides the desired weight (e.g., in the case of shell 112, to compensate for the hollow interior 114), but still deforms adequately to disperse impact forces. Examples of suitable materials include thermoplastics, polycarbonate, and rubber.

The outer cushioning layers (e.g., layer 116 of FIG. 1B, pads 126 of FIG. 1C, or layer 314 of FIG. 3B) are preferably constructed of a compressible material that is more forgiving when impacting a player's body. According to an embodiment of the present invention, the outer layers are applied over the core or shell by insert molding, reaction injection molding, spray application, rotational molding, dual extrusion, or casting. The outer layer is made of a material that is complementary to the material of the core or shell, such that the outer layer strongly bonds to the core or shell, preferably without the use of adhesives or other intermediate bonding layers. Examples of suitable outer layer materials include nylon, urethane (TPU), sanoprene, polycarbonate, alcryln (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), flexible PVC, polyethylene, polypropylene, EVA, and ABS.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A lacrosse ball comprising:

a shell having an exterior and a hollow interior, wherein the shell is made of a first material; and a plurality of pads, made of a second material disposed on the exterior of the shell, wherein the second material has a specific gravity lower than a specific gravity of the first material, wherein the lacrosse ball has a circumference between about 7½ and about 8½ inches, a weight within a range of about 4¾ to about 5½ ounces, and a bounce height within a range of about 40 to about 55 inches, when dropped from a distance of about 65 to about 75 inches onto concrete at a temperature between about 60° F. and about 80° F., and wherein the plurality of pads is disposed on portions of the exterior of the shell, and wherein other portions of the exterior of the shell are exposed between pads of the plurality of pads.

2. The lacrosse ball of claim 1, wherein a pad of the plurality of pads protrudes above the exterior of the shell.

3. The lacrosse ball of claim 1, wherein the shell defines a recess in its exterior, and wherein a pad of the plurality of pads is disposed in the recess.

4. The lacrosse ball of claim 1, wherein the shell is made of a thermoplastic and has a wall thickness of about ¾-inch at its fullest thickness, wherein the plurality of pads takes up about 4 to about 5 square inches of the exterior of the shell, and wherein each pad of the plurality of pads is made of EVA foam and has a thickness of about ½-inch.

5. The lacrosse ball of claim 2, wherein the shell is made of a thermoplastic and has a wall thickness of about ½-inch at its fullest thickness, wherein the plurality of pads takes up about 6 square inches of the exterior of the shell, and wherein each pad of the plurality of pads is made of EVA foam and has a thickness of about ½-inch.

6. The lacrosse ball of claim 1, wherein each pad of the plurality of pads protrudes above the exterior of the shell such that, upon the ball's contacting a planar surface, at least two pads contact the planar surface before the exterior of the shell contacts the planar surface.

7. The lacrosse ball of claim 6, wherein the at least two pads are adapted to deform to enable the exterior of the shell to contact the planar surface.

8. The lacrosse ball of claim 1, wherein each pad of the plurality of pads protrudes above the exterior of the shell such that, upon the ball's contacting a planar surface, the exterior of the shell is prevented from contacting the planar surface.

* * * * *